US006269522B1

(12) United States Patent
Graf et al.

(10) Patent No.: US 6,269,522 B1
(45) Date of Patent: Aug. 7, 2001

(54) METHOD OF OPERATING A CARD AND A CARD FLAT FOR CARRYING OUT THE METHOD

(75) Inventors: Ralph A. Graf, Freienbach; Stefan Geisser, Rapperswil, both of (CH)

(73) Assignee: Graf & Cie AG, Rapperswil (CH)

( * ) Notice: Subject to any disclaimer, the term of this patent is extended or adjusted under 35 U.S.C. 154(b) by 0 days.

(21) Appl. No.: 09/442,665

(22) Filed: Nov. 18, 1999

(30) Foreign Application Priority Data

Nov. 24, 1998 (DE) ..... 198 54 194
Jun. 24, 1999 (EP) ..... 99112186

(51) Int. Cl.[7] ..... D01G 15/12
(52) U.S. Cl. ..... 19/113; 19/102; 19/104
(58) Field of Search ..... 19/98, 99, 100, 19/102, 103, 104, 105, 106 R, 108, 110, 111, 112, 113, 114; 29/23.1

(56) References Cited

U.S. PATENT DOCUMENTS 684,703 * 10/1901 Mills ..... 19/113
4,827,573 * 5/1989 Kuehl ..... 19/102
4,955,111 * 9/1990 Jagst ..... 19/102
5,271,125 12/1993 Leifeld et al. ..... 19/103
5,473,795 12/1995 Spix et al. ..... 19/113
5,542,154 * 8/1996 Demuth et al. ..... 19/114
5,625,924 5/1997 Sauter et al. ..... 19/103
5,749,126 * 5/1998 Patelli et al. ..... 19/102

FOREIGN PATENT DOCUMENTS 42 35 610 A1 10/1992 (DE) ..... D01G/15/00
43 04 148 A1 2/1993 (DE) ..... D01G/15/24
196 51 894 A1 12/1996 (DE) ..... D01G/15/14
0 801 158 A1 3/1997 (EP) ..... D01G/15/28

* cited by examiner

*Primary Examiner*—Danny Worrell
*Assistant Examiner*—Gary L. Welch
(74) *Attorney, Agent, or Firm*—Darby & Darby

(57) ABSTRACT

A method and apparatus for operating a carding machine having a drum with a drum fitting and a plurality of card flats wherein each card flat is provided with a card flat fitting. A predetermined distance between the drum fitting and the card flat fittings is adjusted by conditioning the running surfaces of the card flats.

24 Claims, 4 Drawing Sheets

METHOD OF OPERATING A CARD AND A CARD FLAT FOR CARRYING OUT THE METHOD

BACKGROUND OF THE INVENTION

The present invention relates to a method of operating a carding arrangement which has a drum with a drum fitting and a plurality of card flats. Each card flat is provided with a card flat fitting, wherein the card flat can move relative to the drum along a predetermined path while maintaining a predetermined distance between the drum fitting and the card flat fitting. A running surface of each card flat fitting is in contact along the predetermined path with a guide surface defining the predetermined path. The invention also relates to a card flat for carrying out the method.

Cards operating according to the aforedescribed method are used to orient individual fibers of a raw material, for example material used in the manufacture of yarn. The operation of such a card is as follows: The card includes basically a drum and a several card flats. The second drum is essentially shaped as a circular cylinder and includes a fitting arranged on its outer surface. The fitting of the card is formed of individual wire hooks inserted into a rubber fabric. Alternatively, fittings in the form of saw-tooth wires which helically surround the cylinder axis of the drum, can also be employed. During the operation of the card, the drum is rotated about its cylinder axis.

The card flats are secured to a continuous transport element, such as a transport belt or a transport chain. The transport element can be used to move the card flats relative to the drum along a predetermined path extending approximately parallel to the outer surface of the drum and to then return the card flats above the predetermined path. The transport direction of the card flats along the predetermined path opposes the rotation direction of the drum. The side of each card flat which faces the drum fitting along the predetermined path, has a card flat fitting. The card flat fittings of the card are formed as a wire fabric which is inserted into a rubber fabric.

To orient the individual fibers parallel to each other, raw material provided, for example, in the form of cotton flakes, is supplied to the drum by a taker-in or a supply drum. The taker-in includes a saw-tooth fitting made entirely of steel. The supplied material is captured by the drum fitting and entrained in the rotation direction of the second drum. The fibers entrained by the drum fitting are flattened by the card flats which move along the predetermined path in a direction opposing the rotation direction of the drum. This process produces on the drum fitting a fine pile of oriented fibers which can be removed from the drum with a stripper roller (not shown) for further processing.

For proper carding, the tips of the card flat fittings moving along a predetermined path in the opposite direction of the rotation direction of the drum have to maintain a predetermined distance of approximately 0.15 to 0.18 mm from the tips of the drum fittings. For this purpose, the individual card flats typically have card flat rods supporting the card flat fittings, with hardened guide pins fixedly secured in the card flat rods. The card flat running surfaces formed by the guide pins contact at least along the predetermined path a sliding guide which is typically made of plastic. Card flats of this type are disclosed, for example, in U.S. Pat. No. 5,473,795.

It has been observed that with cards operated in the manner, the carding effect deteriorates with increasing operating time. The drum fittings and the card flat fittings may also be damaged with increasing operating time. These defects are commonly eliminated by applying new fittings to the drum and the card flat, thereby eliminating the defects caused by wear of the fittings. However, it has been observed that even after applying new fittings to the drum and the card flats, the original carding efficiency obtained when the card was first put in service, could no longer be attained and that the fittings were again damaged after operating only for a short time.

SUMMARY OF THE INVENTION

In view of these problems encountered in conventional methods, it is an object of the invention to provide a method for operating a card, wherein short-term damage to the fittings can be prevented and the original carding efficiency obtained at the time, when the card was first put in service, is maintained even after the installation of new fittings. It is a further object of the invention to provide a card flat which can be used for carrying out the method.

According to the invention, the object is solved by improving known methods of operating a card. More particularly, the predetermined distance between the drum fitting and the card flat fittings is adjusted by conditioning the running surfaces of the card flats.

The present invention is based on the observation that the carding effect during long-term operation of a card does not only deteriorate due to wear of the fittings, but also due to contamination and/or wear of the card flat running surfaces. A degradation of the card flat running surfaces can decrease the separation between the fitting tips of the card flat fittings and the fitting tips of the drum fittings to a value of less than 0.15 mm, which can damage the fittings even if new fittings are applied to the card flats and the drum.

The aforedescribed deficiencies can be eliminated with the method according to the invention by conditioning the card flat running surfaces. Conditioning may include removing contamination from the card flat running surfaces in order to counteract an unwanted increase in the distance between the fitting tips of the card flat fittings and the fitting tips of the drum fittings. Conditioning may already be performed when the cards are cleaned.

According to a preferred embodiment of the invention, conditioning may include machining the card flat running surface. In this way, wear of the card flat running surfaces which may cause the card flats to move irregularly along the predetermined path, can be prevented by the method of the invention through remilling or regrinding the card flat running surfaces. According to a particularly preferred embodiment of the invention, a profile milling machine and/or a profile grinding machine may be employed for this operation.

The method according to the invention may be carried out by using—at least in the region of the card flat running surface—card flats made of gray cast iron. Such card flats may advantageously be produced by using card flat rods produced as a single piece which includes the guide elements forming the card flat running surface and the support member forming the contact surface for the card flat fittings.

According to still another preferred embodiment of the invention, to provide excellent wear resistance without increasing the weight of the card flats, the card flat running surface may be formed by at least one running surface member having a fixed position relative to a support member of the card flat and being made of a material which is harder than the material of the support member.

Such running surface member may, for example, have the form of a pin made of hardened steel and inserted into a corresponding aperture in the support member. To precisely guide the card flat along the predetermined path, the card flat for carrying out the method of the invention advantageously comprises at least two running surface sections which are spaced apart from each other in the direction of the predetermined path. The two running section members may advantageously be affixed to the support member of the card flat.

If the pins have a substantially circular cross-section, the card flat running surface and the guide surface can advantageously be prevented from pressing against each other across the entire surface area by flattening the pin, which forms the running surface member, in the region of the card flat running surface, so that the pin has a substantially rectangular surface region. The running surface member may be secured to the support member in a force-transmitting engagement, form-fitting engagement and/or material engagement by using a suitable adhesive. If the card flat running surface is formed by a running surface member made of hardened steel, then remachining may preferably be performed using boron nitride as an abrasive, most preferably using a ring wheel made of boron nitride.

Because material of the part of the card flat forming the card flat running surface is lost when the card flat running surfaces are machined by regrinding and/or re-milling as well as when the card flat running surfaces are cleaned, in another preferred embodiment of the invention at least one card flat running surface is formed by a running surface member which is releasably secured to a support member of the card flat which holds the card flat fittings. Conditioning may include exchanging the running surface member, in addition or alternatively to machining of the card flat running surfaces.

With this embodiment of the invention, the "spent" running surface member can be completely exchanged against a new running surface member after the card flat running surfaces and/or of the running surface members forming the card flat running surfaces are progressively worm, so that original operating conditions of the card can be restored.

After the running surface members are exchanged, the card flat running surface of the new running surface member which is releasably secured to the support member, may be machined by grinding or milling, whereby the characteristics of the new running surface member can be exactly matched to the characteristics of the card actually employed. In particular, the card flat running surface of the new running surface member should be machined in situations where not all card flats of the card receive new running surface members. In this way, the new running surface elements can be matched to the running surface elements of other card flats already in use.

As described above with respect to a preferred embodiment of the inventive method, a suitable card flat for carrying out the method may include a support member for holding a card flat fitting and a card flat running surface for guiding the movement of the card flat along the predetermined path, wherein the card flat running surface is formed by a running surface member which is releasably attached the support member. The running surface member may be attached to the support member in a form-fitting engagement and/or a force-transmitting engagement. The running surface members, while still being reliably secured to the support member, can be easily exchanged by providing an attachment device for attaching the running surface members to the support member. The attachment device includes at least one attachment pin which is preferably disposed on the support member, and at least one aperture which is preferably located in the running surface member and adapted to receive the attachment pin. The attachment pins and the apertures adapted to receive the attachment pins extend in a direction perpendicular the predetermined path. With this arrangement, the running surface members are form fittingly secured to the support member in the travel direction of the card flats and connected in a force-transmitting arrangement in a direction perpendicular thereto, thereby facilitating an exchange of the running surface members.

Tilting of the running surface members with respect to the support members can be prevented if each attachment device provided for securing a running surface member includes at least two mutually parallel attachment pins and two apertures adapted to receive the attachment pins. During the operation of the card, the attachment pins and the corresponding apertures adapted to receive the attachment pins may advantageously be spaced apart from each other in the direction of the predetermined path. If the attachment pins are received in the apertures with a close fit, i.e., without clearance, then the running surface elements can be secured to the support member without using additional fastening elements.

According to another advantageous embodiment of the invention, the dimension of one of the apertures may be greater in a compensation direction which extends perpendicular a longitudinal axis of the apertures, than the corresponding dimension of the attachment pin to be received therein, so that the distance between the individual attachment pins can be maintained and manufacturing tolerances of the card flats can be compensated. With this embodiment of the invention, the running surface member can be reliably secured to the support member without using additional attachment elements by matching the dimension of the corresponding attachment pin exactly to the aperture and the dimension the other aperture exactly to the exact dimension of the corresponding attachment pin in a direction perpendicular to the compensation direction, thereby eliminating any play. Advantageously, the compensation direction extends parallel to the predetermined path, with the card flat moving along the predetermined path.

As discussed above with reference to a preferred embodiment of the method of the invention, in another advantageous embodiment, the card flat running surface includes two running surface sections which during the operation of the card are spaced apart from each other in the direction of the predetermined path and have a preferably rectangular shape.

The card flat of the invention can be precisely guided along the predetermined path if the card flat running surface during the movement of the card flat along the predetermined path is arranged at least in part between at least one of the attachment pins and the guide surface. With this arrangement, the attachment pin provides an effective support for the card flat running surface, thereby preventing an excursion of the card flat running surface which could degrade the guiding accuracy.

Since wear can also occur in the region where the card flat of the invention is coupled to a corresponding transport element, such as a transport belt or a transport chain, the surface element may advantageously have a coupling region in the form of, for example, an aperture or a pin, for coupling the card flat to the transport element.

The card flat running surfaces of the card flats according to the invention can be machined more easily and costeffectively if the running surface member is made of a material, preferably plastic, that is softer than the material of the support member. Advantageously, a material may be selected which is slightly elastically deformable, so that the surface member can be attached to the support member without clearance. The card flat to then move reliably along the path determined by the guide surface.

The card flats used in the manufacture of cards typically include not only the card flat running surface, but also an additional contact surface for the card flat fittings, wherein the contact surface extends approximately parallel to the card flat running surface. Since over an extended operating time the card flat running surfaces of a card abrade differently, the distance between the card flat running surface and the contact surface is advantageously adjusted to the same value at the time the card flat running surface is conditioned. The distance between the fitting tips of the card flat fittings and the fitting tips of the drum fittings can thereby be adjusted to an identical value for all the card flats of the card.

To eliminate unwanted down-time of a card, the card flats running surfaces are advantageously conditioned at the same time the card flats are refitted with new fittings, after the fittings of the drum and the card flats are worn down.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

The invention will be described hereinafter with reference to the drawings to which reference is also made with respect to all details which are important for the invention and which are not described in detail in the specification. The drawings show in.

DETAILED DESCRIPTION OF THE PRESENTLY PREFERRED EMBODIMENTS

Figure 7:
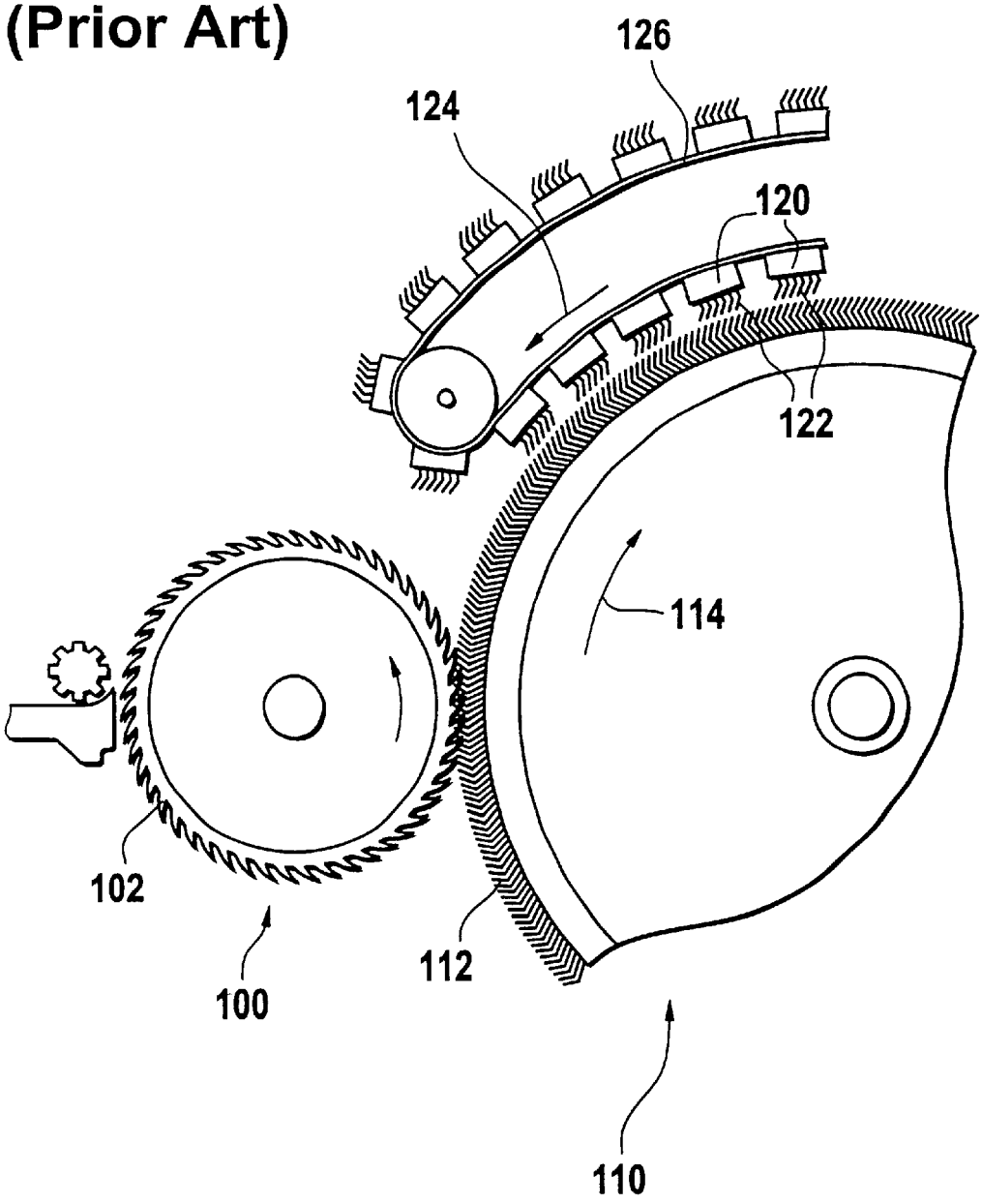
Fig. 7 (Prior Art)

The general operation of a card will be described with reference to FIG. 7. The card includes a drum, designated with the reference numeral 110, and a plurality of card flats 120. The drum 110 is essentially shaped as a circular cylinder and includes a fitting 112 disposed on its outer surface. The fitting 112 of the card illustrated in FIG. 7 is formed of individual wire hooks inserted into a rubber fabric. Alternatively, fittings in the form of saw-tooth wires which helically surround the cylinder axis of the drum, can also be employed. During the operation of the card, the drum is rotated about its cylinder axis, as indicated by the arrow 114.

The card flats 120 are secured to a continuous transport element 126, such as a transport belt or a transport chain. The transport element 126 can be used to move the card flats relative to the drum 110 along a predetermined path extending approximately parallel to the outer surface of the drum 110 and to then return the card flats above the predetermined path. The transport direction of the card flats 120 along the predetermined path is indicated by the arrow 124 and opposes the rotation direction of the drum 110. The side of each card flat which faces the drum fitting along the predetermined path, has a card flat fitting. The card flat fittings of the card illustrated in FIG. 7 are formed as a wire fabric which is inserted into a rubber fabric.

To orient the individual fibers parallel to each other, raw material provided, for example, in the form of cotton flakes, is supplied to the drum by a taker-in 100 or a supply drum. The taker-in 100 includes a saw-tooth fitting 102 made entirely of steel. The supplied material is captured by the drum fitting 112 and entrained in the rotation direction indicated by the arrow 114. The fibers entrained by the drum fitting 112 are flattened by the card flats 120 which move along the predetermined path in a direction opposing the rotation direction of the drum, as indicated by the arrow 124. This process produces on the drum fitting a fine pile of oriented fibers which can be removed from the drum with a stripper roller (not shown) for further processing.

For proper carding, the tips of the card flat fittings 122 moving along a predetermined path in the opposite direction of the rotation direction of the drum 110 have to maintain a predetermined distance of approximately 0.15 to 0.18 mm from the tips of the drum fittings 112. For this purpose, the individual card flats 120 typically have card flat rods supporting the card flat fittings 122, with hardened guide pins fixedly secured in the card flat rods. The card flat running surfaces formed by the guide pins contact at least along the predetermined path a sliding guide which is typically made of plastic. Card flats of this type are disclosed, for example, in DE 43 04 148 A1, or U.S. Pat. No. 5,473,795.

Figure 1:
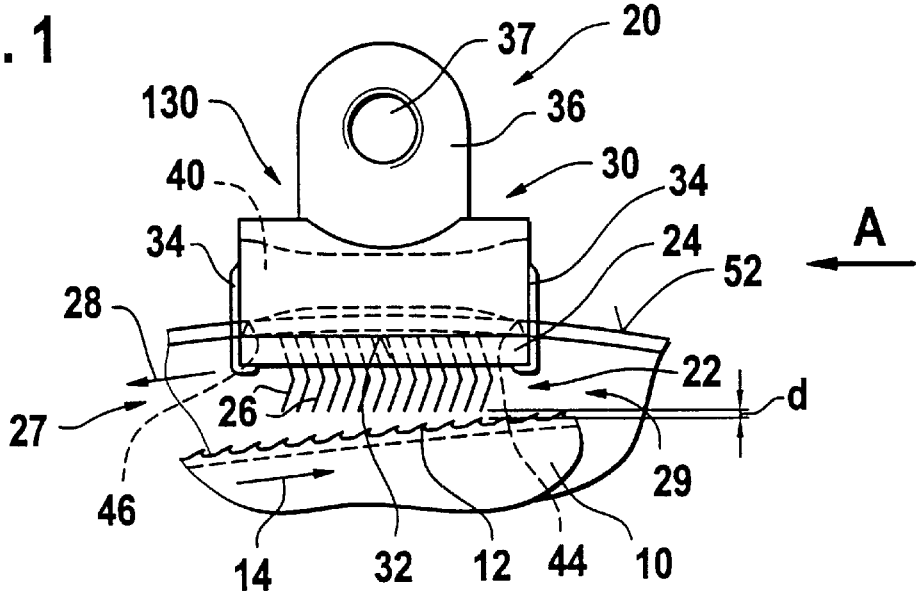
FIG. 1 a side view of a carding location suitable for carrying out a method according to the invention and located between the card flat fitting and the drum fitting, FIG. 2 a view of the carding location of FIG. 1 in a direction indicated in FIG. 1 by the arrow A, FIG. 3 a side view of a carding location suitable for carrying out a method according to a second embodiment of the invention and located between the card flat fitting and the drum fitting, FIG. 4 a view of a carding location of FIG. 3 in the direction indicated in FIG. 3 by the arrow A, FIG. 5 a side view of a flat bar according to the invention, FIG. 6 a top view of the illustrated in FIG. 5, and FIG. 7 a schematic diagram describing the operation of a card.
Figure 2:
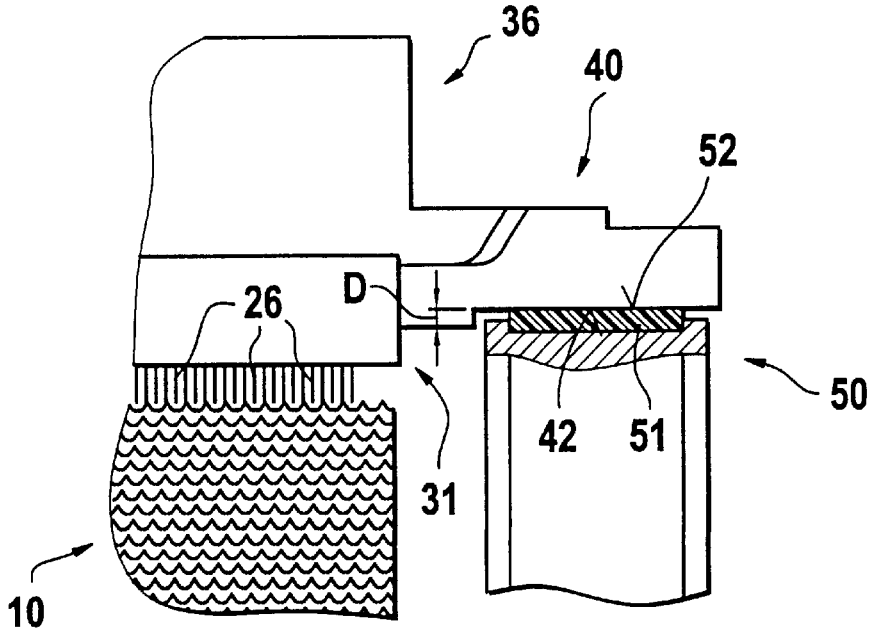

FIGS. 1 and 2 show the drum 10 and a card flat 20 of a card. The card may have a large number, typically between 80 and 112, of identical card flats. The drum has essentially the form of a circular cylinder and includes a fitting 12 in the form of a saw-tooth wire which helically surrounds the cylinder axis. The card flat 20 consists essentially of a flat bar 30 and a card flat fitting 22 which is connected to the flat bar 30 with attachment elements 34. The card flat fitting is formed of a support member 24 and wire hooks 26 inserted therein. The inner surface of the support member 24, which faces away from the drum 10, is urged by the attachment elements 34 against a contact surface 32 of the flat bar 30 so that the card flat fitting 22 is reproducibly positioned relative to the card flat 20. The flat bar 30 includes a support body 130 which forms the contact surface 32 and holds the card flat fitting 22, and a guide element 40 for guiding the movement on the card flat along a predetermined path. The support body of the cast card flat illustrated in the FIGS. 1 and 2 has a reinforcement element 36 which is located on the side of the support body facing away from the contact surface 32 and provided with an aperture 37. The reinforcement element of the aluminum card flats illustrated in FIGS. 3 to 6 has the form of a hollow profile. This arrangement makes the flat bar 30 stiffer without increasing its weight.

During the carding operation, the drum 10 rotates about its cylinder axis. In the illustrated embodiment of the invention, the card flat 20 moves along the guide surface 52 which has a sliding guide 50 with a plastic insert 51. In the card illustrated in FIGS. 1 and 2, the card flat moves in a direction which opposes the rotation direction of the drum 10, as indicated by the arrow 14. However, the invention can also be implemented with cards which move slower than the drum in the same direction as the rotation direction of the drum. A sliding guide for the card flats which preferably consists at least partially of hardened gray cast iron, can also be employed. When the card flat 20 moves along the predetermined path, a card flat running surface provided on the guide element 40 of the flat bar 30 reliably maintains a distance d in a range of 0.15 to 0.18 mm between the fitting tips of the card flat fitting 22 and the fitting tips of the drum fittings 12.

As shown more particularly in FIG. 2, the guide element 40 of the flat bar 30 extends from the support body 130 in a direction approximately perpendicular to the predetermined path and is essentially positioned next to the drum 10. The sliding guide 50 made of plastic is also arranged next to the drum 10, as shown in FIG. 2. As seen in FIG. 1, the card flat running surface 42 has two mutually parallel, spaced-apart running surface sections 44, 46 which extend approximately perpendicular to the path defined by the guide surface 52. Between the running surface sections 44, 46, there is arranged a region of the outer surface of the guide element 40 which curves upwardly away from the guide surface. This shape of the card flat running surface 40 provides reliable guiding along the guide surface 52 of the sliding guide 50 and also facilitates machining of the card flat running surface by re-grinding and/or re-milling since the card flat running surface area can be quite small.

The running surface sections 44 and 46 of the card flat running surface 42 extend approximately parallel to the contact surface 32 for the card flat fitting 22, wherein a taper of between 0° 45' and 1° 30' may be provided depending on the card type. The conditioning process according to the invention ensures that—after the installation of new fittings—the same separation d is maintained between the fitting tips of the drum fittings 12 and the fitting tips of the card flat fitting 22 for all card flats of a card, by adjusting the separation D between the running surface sections 44 and 46 and the contact surface 32 to the same value for all card flats. However, the separation d along the predetermined path may vary slightly, in particular increase, from the entrance 27 of the card flats to the exit 29 of the card flats, in which the guide surface 52 extends radially to the drum axis.

If machining of the card flat running surface 42 causes an unwanted decrease in the separation between the card flat fitting 22 and the drum fitting 12, then this separation can be readjusted to the desired value by a corresponding adjustment of the sliding guide 50. The flat bar 30 depicted in FIGS. 1 and 2, including the reinforcement 36 and the guide element 40 and also the card flat running surface 42, are made in one piece of gray cast iron.

Figure 3:
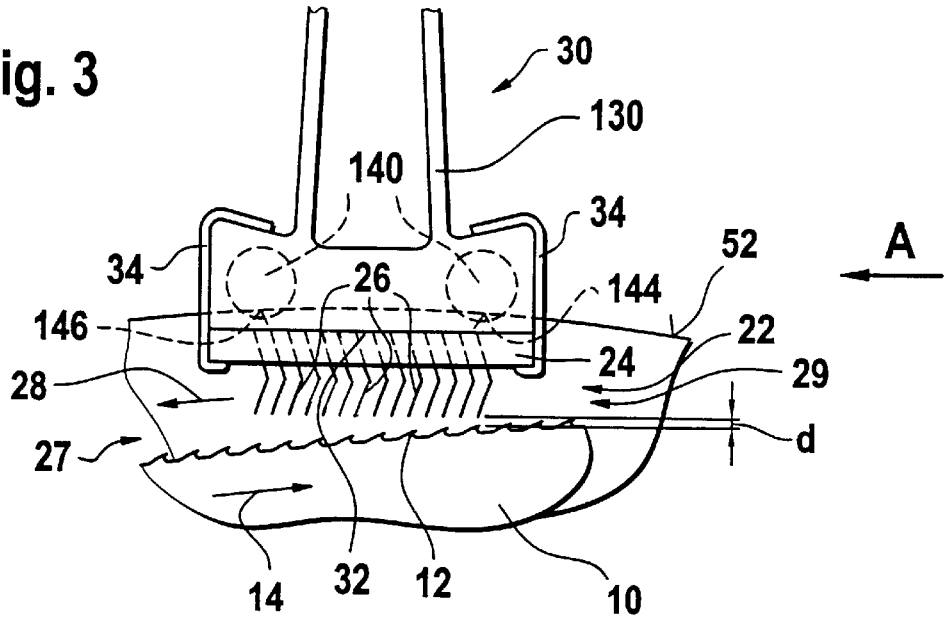
Figure 4:
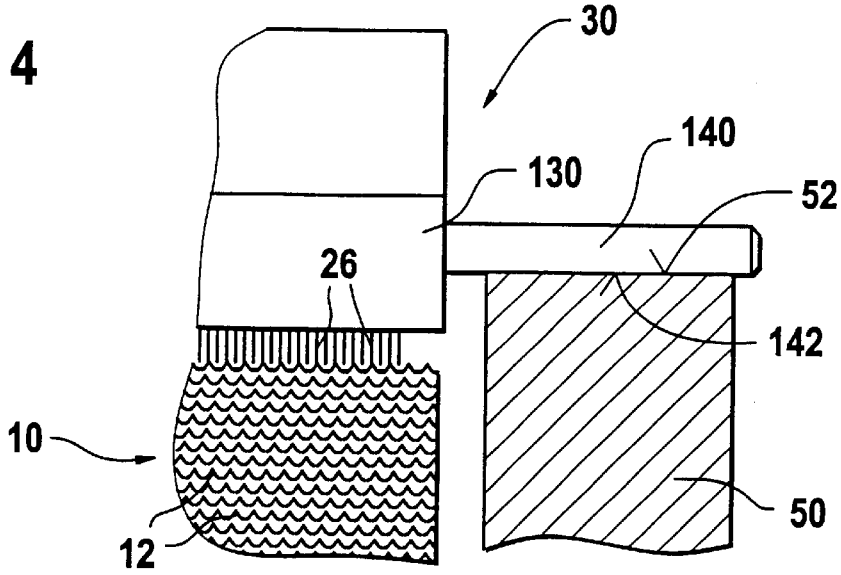

The card illustrated in FIGS. 3 and 4 for carrying out a method according to the invention corresponds essentially to the card illustrated in FIGS. 1 and 2. Accordingly, the elements of the card illustrated in FIGS. 3 and 4 have the same reference numerals as the corresponding elements of FIGS. 1 and 2.

Unlike the card described with reference to FIGS. 1 and 2, the card illustrated in the FIGS. 3 and 4 has a flat bar 30 which consists of a support body 130 forming the contact surface of the card flat fitting 22 with running surface elements 140 which are in force-transmitting engagement with the support body 130 and form the card flat running surface 142. The support body 130 is formed of extruded aluminum profile, whereas the running surface elements 140 are made of hardened steel. As seen more clearly in FIG. 3, the running surface elements 140 are received in corresponding apertures of the support body 130. The portion of the guide elements 140 received in the support body 130 has a circular cross-section. The portion of the running surface elements 140 protruding from the support body and forming the running surface sections 144 and 146 also has an approximately circular cross-section. In the region of the running surface sections 144 and 146, however, the running surface elements 140 are flattened to form the essentially rectangular running surface sections 144 and 146. In this way, pressure exerted on the area between the running surface sections 144 and 146 and the guide surface 52 can be decreased. Providing the running surface elements 140 with a flat portion also increases the angle subtended between the guide surface 52 and the surface regions of the exposed guide surface elements 140 located outside the running surface sections 144 and 146. This arrangement reduces the amount of contamination that can accumulate in and attach to the region of the running surface 142. The invention can also be used with new card flats which may initially have round guide elements, i.e. guide elements which are not flattened and which assume flat surface portions only during operation. Depending on the type of card used, such round guide elements may advantageously be less susceptible to malfunction.

Further details of the card flats which are illustrated in the FIGS. 3 and 4 and particularly suited for carrying out the method of the invention, are described in U.S. Pat. No. 5,473,795 and incorporated in the present specification by reference.

The card flat running surface 142 and the card flat running surface sections 144 and 146 of the running surface elements, respectively, of the card flats illustrated in the FIGS. 3 and 4 can be easily re-machined using a grinding ring made of boron nitride. This process advantageously employs a profile milling machine and/or a profile grinding machine.

The flat bar 200 illustrated in the FIGS. 5 and 6 combines the features of the flat bar described with reference to the FIGS. 1 and 2 with those of the flat bar described with reference to the FIGS. 3 and 4. Like the flat bar discussed with reference to FIGS. 3 and 4, the flat bar illustrated in FIGS. 5 and 6 includes a support body 230 having two pins 250 which extend perpendicular to the movement direction of the card flat along the predetermined path indicated by the arrow 28. The pins 250 are spaced apart from each other in the direction of predetermined path. In the embodiment of the invention illustrated in the FIGS. 5 and 6, the pins 250 attached to the support body 230 do not operate as running surface elements of the flat bar 200, but allow attaching a separate running surface element 240 to the support body 230. The running surface element 240 has essentially the same form as the guide element 40 described with reference to FIGS. 1 and 2. Accordingly, the running surface element 240 has two mutually parallel, spaced-apart running surface sections 244 and 246 which extend approximately perpendicularly to the path defined by a guide surface. Between the running surface sections 244, 246, there is arranged a section of the outer surface of the guide element which curves upwardly away from the guide surface. Depending on the card type, a taper of between 0° 45' and 1° 30' may be provided. Two apertures 248 and 249 which are spaced apart from each other in a direction parallel to the predetermined path 28, penetrate the running surface element 240 in a direction perpendicular to the predetermined path 28. The distance between the apertures 248 and 249 is selected so as to essentially correspond to the separation between the two pins 250 which are secured to the support body 230. Moreover, the cross-section of the apertures 248 and 249 matches the cross-section of the attachment pins 250. The running surface element 240 is thus secured to the support body 230 by sliding the running surface element 240 onto the attachment pins 50. The dimensions of the apertures 248 and 249 are selected to match the dimensions of the attachment pins 250 so that the running surface element 240 is held on the support 230 of the flat bar 200 without additional fastening elements. To compensate for manufacturing tolerances which can cause variations in the spacing between the individual attachment pins 250 from the nominal spacing, the width of the aperture 249 in a direction parallel to the predetermined path 28 is slightly greater than the diameter of the attachment pin 250 to be received in the aperture. The running surface element 240 depicted in FIGS. 5 and 6 is entirely made of plastic which saves cost and facilitates machining of the running surface sections 244 and 246.

Figure 5:
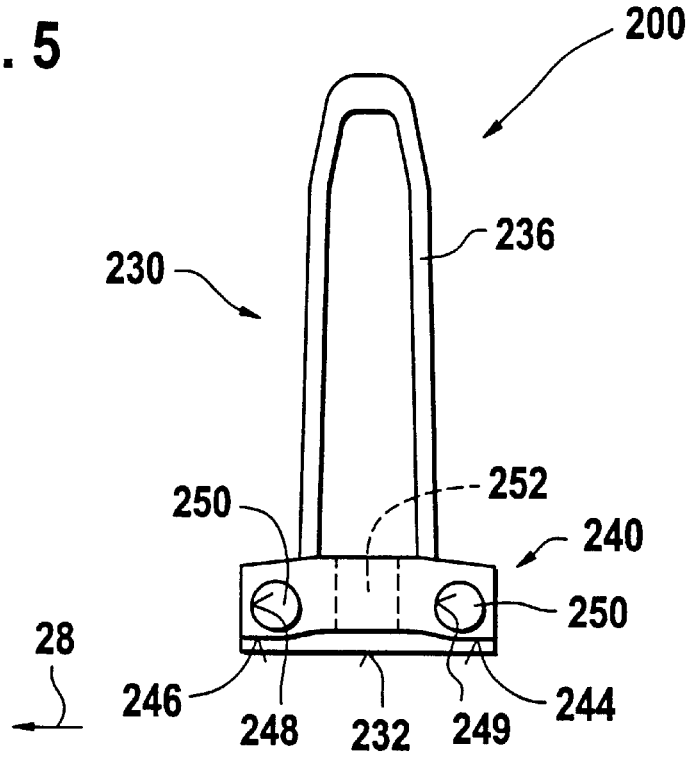

As illustrated with particularity in FIG. 5, one side of the flat bar 200 which is located opposite to a contact surface 232 for the card flat fittings, has a hollow profile 236, thereby increasing the stiffness of the flat bar 200 without significantly increasing its weight. To keep the weight as low as possible, the support body 230 of the flat bar may be made of an extruded aluminum profile.

The flat bar 200 illustrated in FIGS. 5 and 6 can move more stably along the predetermined path 28 by arranging the running surface sections 244 and 246 exactly below the location of the attachment pins 250. The attachment pins 250 prevent the running surface sections 244 and 246 during their travel along the predetermined path 28 from moving in a direction perpendicular to the predetermined path.

Figure 6:
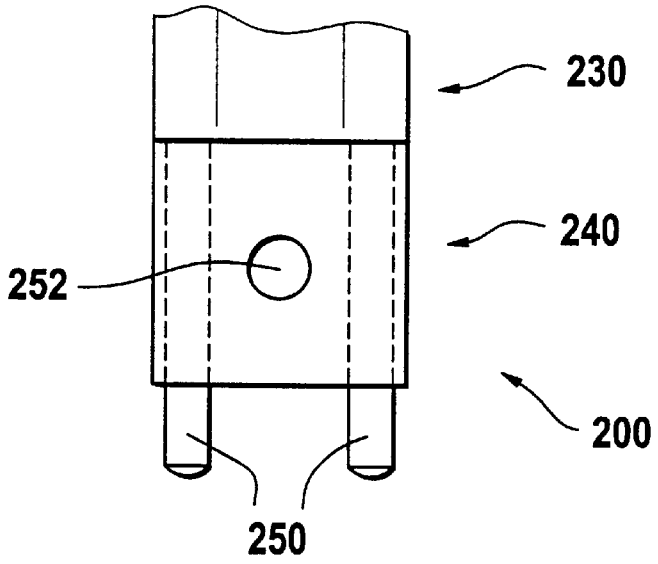

As also seen in FIGS. 5 and 6, an aperture 252 extending perpendicular to the predetermined path 28 penetrates the running surface element 240 between the running surface segments 244 and 246. The aperture 252 forms a coupling region for a transport element which may be implemented as a transport belt or a transport chain.

When the running surface sections 244 and 246 wear down during the operation of the flat bar illustrated in the FIGS. 5 and 6, the running surface element 240 can be removed in its entirety from the attachment pins 250 and replaced by a new running surface element 240. To match the new running surface element 240 with the particular characteristics of the card, the running surface elements 244 and 246 may be subjected to an additional machining operation, in particular grinding or milling, after they have been exchanged in order to ensure a predetermined separation between the contact surface 232 and running surface sections 244 and 246.

The invention is not limited to the embodiments discussed with reference to the drawings. The drum 10 may also be provided with a fitting in the form of wire hooks. Moreover, the sliding guide may also be arranged above the drum. In another embodiment, the card flat running surface may include more than two running surface sections which may be spaced apart from each other parallel to the direction of the predetermined path and extend essentially perpendicular to the predetermined path.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. The method of operating and performing maintenance on a card with a drum including a drum fitting and a plurality of card flats having respective card flat fittings, comprising the steps of moving the card flat relative to the drum along a predetermined path while maintaining a predetermined distance between the drum fitting and the card flat fitting;

maintaining a running surface of each card flat fitting in contact along the predetermined path with a guide surface defining the predetermined path;

adjusting the predetermined distance between the drum fitting and the card flat fittings by reconditioning the running surfaces of the card flats.

2. A method of operating a card with a drum including a drum fitting and a plurality of card flats having respective card flat fittings, comprising the steps of moving the card flat relative to the drum along a predetermined path while maintaining a predetermined distance between the drum fitting and the card flat fitting;

maintaining a running surface of each card flat fitting in contact along the predetermined path with a guide surface defining the predetermined path;

adjusting the predetermined distance between the drum fitting and the card flat fittings by reconditioning the running surfaces of the card flats;

wherein each card flat comprises a contact surface for the card flat fitting, with the contact surface being approximately parallel to the running surface of the card flat fitting; and wherein the distance between the running surface of the card flat and the contact surface for all card flats is adjusted to an identical value by the re-conditioning process.

3. The method according to claim 2, wherein conditioning of the card flat running surface is performed when the card flats are newly arrayed.

4. The method according to claim 3, wherein reconditioning comprises machining the card flat running surface.

5. The method according to claim 4, wherein, for adjusting the predetermined distance, the card flat running surface is machined using a profile milling machine.

6. The method according to claim 4, wherein the card flat running surface is formed by at least one running surface member having a fixed position relative to a support member of the card flat and being made of a material which is harder than the material of the support member.

7. The method according to claim 6, wherein the running surface member is implemented in the form of at least one pin made of hardened steel.

8. The method according to claim 7, wherein the pin has a substantially circular cross-section and is flattened in an area of the card flat running surface for the purpose of forming a substantially rectangular surface region.

9. The method according to claim 8, wherein the running surface member is secured to the support member in a force-transmitting engagement, form-fitting engagement and material engagement.

10. The method according to claim 9, wherein machining is performed using boron nitride as an abrasive.

11. The method according to claim 10, wherein the at least one card flat running surface is formed by a running surface member which is secured to a support member of the card flat which holds the card flat fittings, and reconditioning includes exchanging the running surface member.

12. The method according to claim 8, wherein the running surface member is secured to the support member in a force-transmitting engagement and material engagement.

13. The method according to claim 9, wherein machining is performed using boron nitride as an abrasive, using a ring wheel made of boron nitride.

14. A flat bar for a carding machine, comprising a support member (230) for holding a card flat fitting and a card flat running surface (244, 246) for guiding the movement of the card flat along a predetermined path;

the card flat running surface (244, 246) is formed by a running surface member (240) which is releasably attached to the support member (230) by an attachment device including at least one attachment pin (250) which is disposed on the support member (230), and by at least one aperture (248, 249) which is disposed in the running surface member (240) and adapted to receive the attachment pin (250).

15. The flat bar according to claim 14, further comprising an attachment device for attaching the running surface members (240) to the support member (230), the attachment device including at least one attachment pin (250) which is disposed on the support member (230), and by at least one aperture (248, 249) which is disposed in the running surface member (240) and adapted to receive the attachment pin (250).

16. The flat bar according to claim 15, wherein the attachment device comprises two mutually parallel attachment pins (250) and two apertures (248, 249) adapted to receive the attachment pins.

17. The flat bar according to claim 16, wherein a width of one of the apertures (249) is greater in a compensation direction (28) which extends perpendicular to a longitudinal axis of the apertures, than the corresponding dimension of the attachment pin (250) to be received therein.

18. The flat bar according to claim 17, wherein the card flat running surface comprises two running surface sections (244, 246) which during the operation of the card are spaced apart from each other in the direction of the predetermined path (28) and have a rectangular shape.

19. The flat bar according to claim 18, wherein during the movement of the card flat along the predetermined path (28), the card flat running surface (244, 246) is arranged at least in part between at least one of the attachment pins (250) and the guide surface.

20. The flat bar according to claim 19, wherein the running surface element (240) comprises a coupling region (252) having the form of an aperture for coupling the card flat to a transport element, such as a transport belt or a transport chain.

21. The flat bar according to claim 20, wherein the running surface member is formed of a material which is softer than the material of the support member.

22. The flat bar according to claim 19, wherein the running surface element (240) comprises a coupling region (252) having the form of a pin for coupling the card flat to a transport element, such as a transport belt or a transport chain.

23. The flat bar according to claim 14, wherein the running surface member (240) is attached to the support member (230) in force-transmitting engagement.

24. A method of operating a card with a drum including a drum fitting and a plurality of card flats having respective card flat fittings, comprising the steps of moving the card flat relative to the drum along a predetermined path while maintaining a predetermined distance between the drum fitting and the card flat fitting;

maintaining a running surface of each card flat fitting in contact along the predetermined path with a guide surface defining the predetermined path;

adjusting the predetermined distance between the drum fitting and the card flat fittings by reconditioning the running surfaces of the card flats, and wherein each card flat comprises a contact surface for the card flat fitting, with the contact surface being formed to taper approximately 0° 45' to 1° 30' with the running surface of the card flat fitting; and wherein the distance between the running surface of the card flat and the contact surface for all card flats is adjusted to an identical value by the conditioning process.

* * * * *